US007036829B2

(12) United States Patent
Maxwell et al.

(10) Patent No.: US 7,036,829 B2
(45) Date of Patent: May 2, 2006

(54) RETRACTABLE SKATES AND METHOD THEREFOR

(76) Inventors: LeVar M. Maxwell, 4561 Avondale Ave., Las Vegas, NV (US) 89121; Stanley H. Bennett, 12819 S. 40th Pl., Phoenix, AZ (US) 85044

( * ) Notice: Subject to any disclaimer, the term of this patent is extended or adjusted under 35 U.S.C. 154(b) by 138 days.

(21) Appl. No.: 10/761,838

(22) Filed: Jan. 20, 2004

(65) Prior Publication Data

US 2005/0156393 A1 Jul. 21, 2005

(51) Int. Cl.
*A63C 17/02* (2006.01)

(52) U.S. Cl. ..... 280/11.223; 280/7.13; 280/11.27

(58) Field of Classification Search ..... 280/7.13, 280/841, 11.19, 11.221, 11.223, 11.224, 11.225, 280/11.231, 11.233, 11.25, 11.26, 11.27, 280/11.28
See application file for complete search history.

(56) References Cited

U.S. PATENT DOCUMENTS 3,884,485 A * 5/1975 Walle
3,979,842 A * 9/1976 Texidor
3,983,643 A * 10/1976 Schreyer et al.
4,333,249 A * 6/1982 Schaefer
5,398,970 A * 3/1995 Tucky ..... 280/841
6,065,759 A * 5/2000 Wu ..... 280/11.115
6,120,039 A * 9/2000 Clementi
6,308,964 B1 * 10/2001 Chang ..... 280/11.19
6,336,644 B1 * 1/2002 Chu ..... 280/11.233
6,386,555 B1 * 5/2002 Kao ..... 280/7.13
6,386,556 B1 * 5/2002 Yeh ..... 280/11.223
6,402,162 B1 * 6/2002 Chiang ..... 280/11.233
6,572,120 B1 * 6/2003 Chang ..... 280/11.233
6,585,273 B1 * 7/2003 Chiu
6,631,911 B1 * 10/2003 Chen et al.

* cited by examiner

*Primary Examiner*—Christopher P. Ellis
*Assistant Examiner*—Kelly Campbell
(74) *Attorney, Agent, or Firm*—Harry M. Weiss; Weiss, Moy & Harris, P.C.

(57) ABSTRACT

A retractable skate and method using armatures that extend for skating and retract for walking. It is preferred that the armatures may be locked into position. It is also preferred that the armatures fasten to a pair of wheels, a frame holding a configuration of wheels, or an ice blade.

10 Claims, 3 Drawing Sheets

RETRACTABLE SKATES AND METHOD THEREFOR

FIELD OF THE INVENTION

This invention relates generally to skates, and more particularly, to skates that feature retractable armatures attached to a shoe for quick conversion of the shoe between skating and walking.

DESCRIPTION OF THE RELATED ART

Inline skating has recently surged in popularity as a fun and efficient mode of personal transportation and also a source of beneficial exercise. Typically, traditional inline skates have a shoe or boot body that encloses the foot and a frame permanently attached to the underside of the shoe that holds multiple wheels in a linear arrangement. This traditional arrangement has the disadvantage of requiring the wearer to carry an additional set of footwear for walking in areas where skating is impractical or not allowed.

Several designs have emerged that attempt to solve this problem. One common variation is to provide a rigid enclosure having attached wheels that fits over normal footwear, allowing wearers to fasten or remove the skates while keeping their regular shoes on. While this approach removes the need to carry shoes while skating, the wearer must still carry bulky skates while walking.

Another popular variation is to incorporate a small wheel in a thick shoe sole with a mechanism to allow the wheel to be retracted into the shoe for walking or extended for skating. This variation limits the size of the wheel to be no bigger than the thickness of the sole to allow complete retraction for walking. However, such a small wheel can be unsafe because the wheel is unable to roll over obstructions such as pebbles or cracks that would not impede a normal wheel. In addition, the small wheel and minimal clearance with the sole of the shoe limit the skater to a much slower speed than is obtainable with regular skates with higher clearance and larger wheels.

A need therefore exists to provide a skate that allows the wearer to quickly transition between skating and walking without requiring two sets of footware and without sacrificing-safety or speed. The present invention satisfies these needs, and provides other, related, advantages.

SUMMARY OF THE INVENTION

It is an object of the invention to provide a retractable skate and method that allows a quick and easy conversion of a shoe or boot from skating to walking.

It is a further object of the invention to provide a retractable skate and method that allows a quick and easy conversion of a shoe or boot from skating to walking while requiring the wearer to carry a minimal amount of extra equipment.

It is a still further object of the invention to provide a retractable skate and method that allows a quick and easy conversion of a shoe or boot from skating to walking without sacrificing the speed achievable with a long inline wheel base and large wheels.

It is a still further object of the invention to provide a retractable skate and method that allows a quick and easy conversion of a shoe or boot from skating to walking without sacrificing the relative safety provided by wheels larger than typical-road obstructions.

It is a still further object of the invention to provide a retractable skate and method that allows a quick and easy conversion from walking to skating on wheels or to ice skating.

The foregoing and other objects, features, and advantages of the invention will be apparent from the following, more particular, description of the preferred embodiments of the invention, as illustrated in the accompanying drawings.

BRIEF DESCRIPTION OF THE PREFERRED EMBODIMENTS

The foregoing objectives are achieved in the retractable skates and method therefor.

In accordance with one embodiment, a retractable skate is disclosed. The retractable skate has a sole dimensioned to be coupled to a shoe, the sole defining at least one recess therein. The retractable skate has a first armature having a first end and a second end and dimensioned to be retained in a stored position in the at least one recess of the sole, the first end of the first armature being pivotally coupled to the sole within the at least one recess, and the second end of the first armature being dimensioned to extend out of the at least one recess when in use. The retractable skate has a second armature having a first end and a second end and dimensioned to be retained in the at least one recess of the sole, the first end of the second armature being pivotally coupled to the sole within the at least one recess, the second end of the second armature being dimensioned to extend out of the at least one recess when in use. The retractable skate has at least one surface interface for providing travel on a surface and dimensioned to be coupled to the second end of the first armature and the second end of the second armature when the second end of the first armature and the second end of the second armature are extended out of the at least one recess.

In accordance with another embodiment, a method of using a retractable skate is disclosed, comprising the steps of: providing a sole dimensioned to be coupled to a shoe and defining at least one recess therein; providing a first armature having a first end and a second end and dimensioned to be retained in a stored position in the at least one recess of the sole, the first end of the first armature being pivotally coupled to the sole within the at least one recess; providing a second armature having a first end and a second end and dimensioned to be retained in a stored position in the at least one recess of the sole, the first end of the second armature being pivotally coupled to the sole within the at least one recess; providing at least one surface interface for effective travel on a surface; extending both the second end of the first armature and the second end of the second armature out of the at least one recess; coupling the at least one surface interface to both the second end of the first armature and the second end of the second armature; and traveling with the at least one surface interface making contact with a travel surface.

BRIEF DESCRIPTION OF THE DRAWINGS

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIG. 11 is an illustration depicting a bottom view of the retractable inline speed skate of FIG. 10 in a walking position having sliding panels in accordance with a preferred embodiment of the present invention.

DESCRIPTION OF EMBODIMENTS OF THE INVENTION

Figure 1:
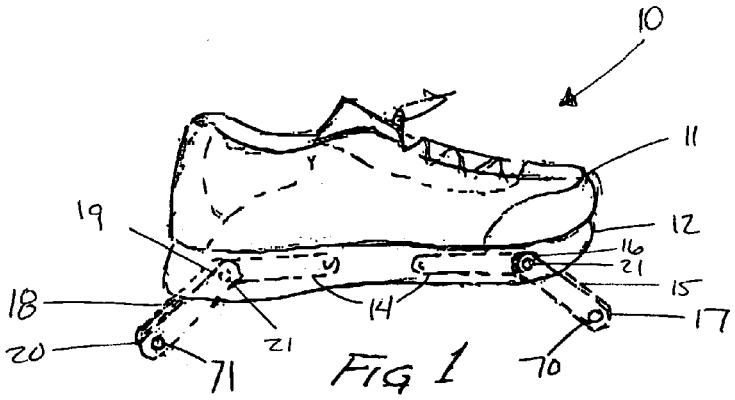
FIG. 1 is an illustration depicting a side elevational and partially perspective view of a retractable inline speed skate with extended armatures in accordance with a preferred embodiment of the present invention.

With reference now to the figures, and in particular to FIG. 1, an embodiment of the retractable skate of the present invention, hereinafter retractable skate 10 is shown. The retractable skate 10 comprises a sole 12 dimensioned to be coupled to a shoe 11. The sole 12 defines at least one recess 14, and preferably two recesses 14, therein. The retractable skate 10 further comprises a first armature 15 having a first end 17 and a second end 18. The first armature 15 is dimensioned to be retained in a stored position in the at least one recess 14 of the sole 12. The first end 16 of the armature 15 is pivotally coupled to the sole 12 within the at least one recess 14. In this way, the second end 17 of the first armature 15 is capable of being rotated from a stored position within the at least one recess 14 to an extended position extending outward from the sole 12.

The retractable skate 10 further comprises a second armature 18 having a first end 19 and a second end 20. The second armature 18 is dimensioned to be retained in a stored position in the at least one recess 14 of the sole 12. The first end 19 of the second armature 18 is pivotally coupled to the sole 12 within the at least one recess 14. In this way, the second end 20 of the second armature 18 is capable of being rotated from a stored position within the at least one recess 14 to an extended position extending outward from the sole 12.

The retractable skate 10 further comprises at least one surface interface 31 for providing travel on a surface. The surface interface 31 is dimensioned to be coupled to the second end 17 of the first armature 15 and the second end 20 of the second armature 18 when the second end 17 of the first armature 15 and the second end 20 of the second armature 18 are extended out of the at least one recess 14. Preferably, the at least one surface interface is one of a blade 60 (shown in FIG. 9), a pair of wheels 24 and 25 (shown in FIG. 3), and a frame 50 housing a plurality of wheels 52 (shown in FIG. 8).

Figure 3:
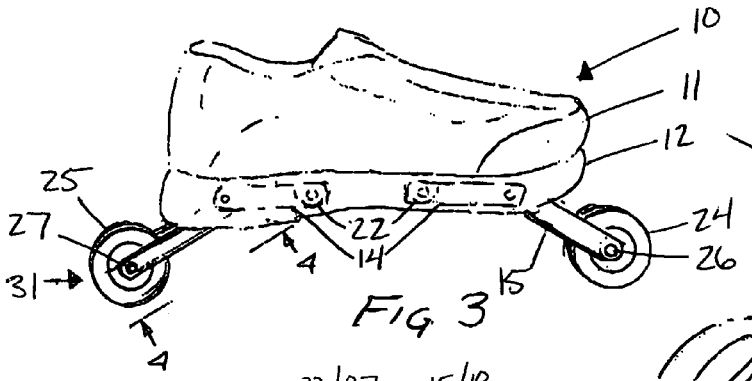
FIG. 3 is an illustration depicting a side elevational and partially perspective view of a retractable inline speed skate similar to FIG. 1 with wheels to provide a skating position in accordance with a preferred embodiment of the present invention.
Figure 8:
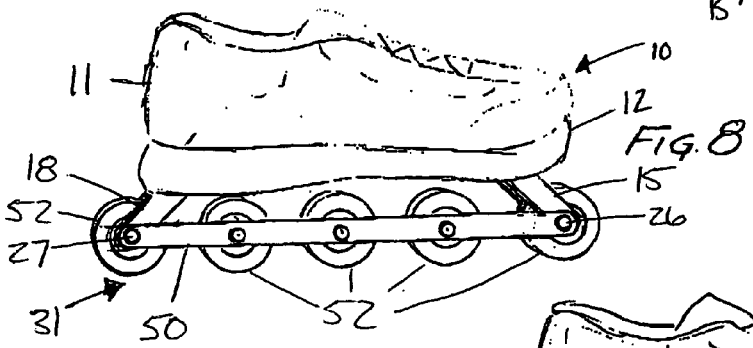
FIG. 8 is an illustration depicting a side elevational and partially perspective view of a retractable inline speed skate in a skating position having a frame housing multiple wheels in accordance with a preferred embodiment of the present invention.
Figure 9:
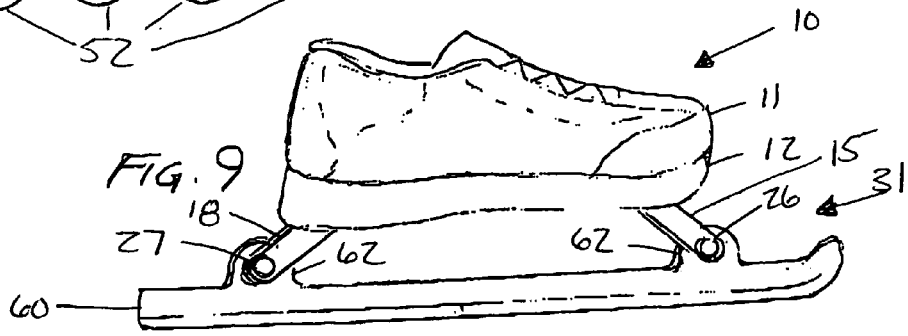
FIG. 9 is an illustration depicting a lateral view of a retractable inline speed skate in a skating position having a blade in accordance with a preferred embodiment of the present invention.

The surface interface 31 comprising a pair of wheels 24 and 25 as shown in FIG. 3 allows a quick conversion from walking to skating while requiring a minimum of additional material that must be carried by a wearer. In the surface interface 31 shown in FIG. 8, a frame 50 holds multiple wheels 52 in a traditional inline skating arrangement. Although the traditional inline skating arrangement is shown in FIG. 8, it is within the spirit and scope of the present invention that the frame 50 may house wheels 52 in a two-by-two rollerskating arrangement (not shown) or any other arrangement of wheels such as triangular or pentagonal. FIG. 9 shows another surface interface 31 comprising an ice blade 60 for low-friction travel with a skating surface such as ice. Preferably, the ice blade 60 has strengthened protrusions 62 dimensioned to fasten to the armatures 15 and 18.

While, in the preferred embodiment, the surface interface 31 of the retractable skate 10 comprises one of a blade 60, a pair of wheels 24 and 25, and a frame 50 housing a plurality of wheels 52, it should be clearly understood that substantial benefit could be derived from an alternative embodiment of the present invention in which an alternative surface interface 31 is used, such as skis (not shown), so long as that surface interface is capable of permitting a person to travel effectively on a surface. For example, a mountain climber traveling on hard ice may choose to attach spikes, nails or some other type of surface interface 31 designed for high-friction travel to the first armature 15 and the second armature 18 in order to more effectively grip a particular surface.

Figure 2:
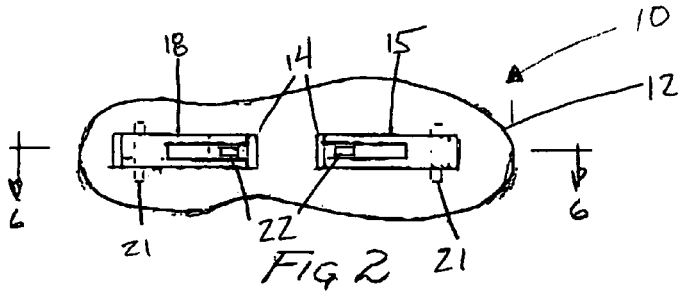
FIG. 2 is an illustration depicting a bottom view of the retractable inline speed skate of FIG. 1 with retracted armatures in accordance with a preferred embodiment of the present invention.

FIG. 1 depicts both of armatures 15 and 18 in an extended position. In order to allow a wearer to walk normally, both armatures 15 and 18 are preferably rotated from an extended position as shown in FIG. 1 into a stored position. FIG. 2 depicts a bottom view of the sole 12 showing both armatures 15 and 18 in a stored position inside recesses 14 in accordance with a preferred embodiment of the present invention. Although FIGS. 1 and 2 depict the sole 12 defining two recesses 14, it should be clearly understood that substantial benefit could also be derived from an alternate embodiment having the sole 12 defining a single recess dimensioned to accommodate both armatures 15 and 18 (not shown).

In FIG. 3 an embodiment of the present invention having both armatures 15 and 18 in an extended position with a surface interface 31 attached is shown. The surface interface 31 shown in FIG. 3 is a pair of wheels 24 and 25, a first wheel 24 attached to the second end 17 of the first armature 15 and a second wheel 25 attached to the second end 20 of the second armature 18. As depicted in FIG. 3, the second end of each of the armatures 15 and 18 are sufficiently distanced from the sole 12 to allow free rotation of the wheels 24 and 25. Although both wheels 24 and 25 are depicted as similarly dimensioned, it should be clearly understood that substantial benefit may be obtained by having the wheels 24 and 25 of differing sizes, shapes, or materials; for example, the front wheel 24 may have a smaller radius than the back wheel 25 for greater speed. As another example, the front wheel 24 may have a narrower outer edge than the back wheel 25 for lower friction and greater maneuverability.

Figure 4:
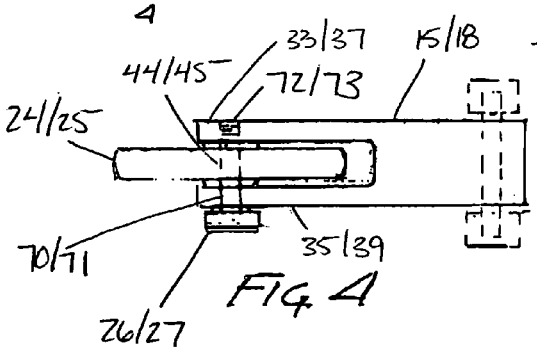
FIG. 4 is an illustration of a retractable inline speed skate depicting a view along the sight line 4—4 designated in FIG. 3 showing an armature in accordance with a preferred embodiment of the present invention.
Figure 5:
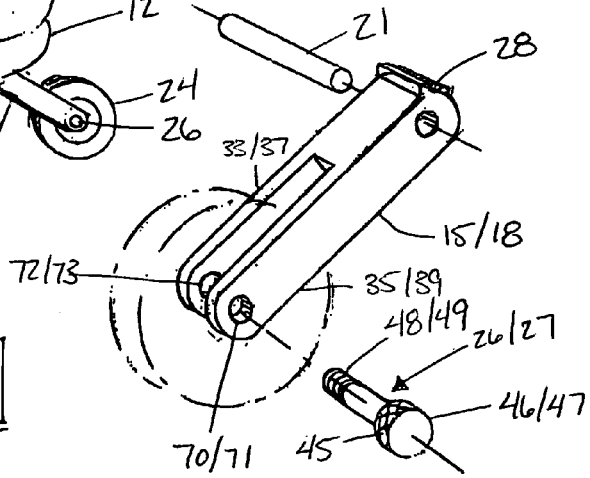
FIG. 5 is an illustration depicting an exploded, enlarged perspective view of an armature in accordance with a preferred embodiment of the present invention.

Referring now to FIGS. 4 and 5, the retractable skate 10 preferably further comprises a first fastener 26 dimensioned to couple the at least one surface interface 31 to the second end 17 of the first armature 15. The retractable skate 10 preferably further comprises a second fastener 27 dimensioned to couple the at least one surface interface 31 to the second end 20 of the second armature 18.

In the preferred embodiment, the first fastener 26 and the second fastener 27 each comprise a threaded end 48 and 49 and a head 46 and 47 having ridges 45. The ridges 45 are dimensioned to allow each of the first fastener 26 and the second fastener 27 to be rotated by hand. While, in the preferred embodiment, the heads 46 and 47 of fasteners 26 and 27 have ridges 45 dimensioned to allow rotation of fasteners 26 and 27 by hand, it should be clearly understood that substantial benefit could be derived from an alternative embodiment of the present invention in which at least one of head 46 of fastener 26 and head 47 of fastener 27 is dimensioned to allow other methods of rotation. For example, at least one head 46 or 47 may define a slot, cross, hexagonal or similar cavity for allowing manipulation using standard fastening tools.

In the preferred embodiment, the second end 17 of the first armature 15 defines a threaded aperture 72 and the second end 20 of the second armature 18 defines a threaded aperture 73. The threaded end 48 of the first fastener 26 is dimensioned to couple to the first armature 15 through the threaded aperture 72. The threaded end 49 of the second threaded fastener 27 is dimensioned to couple to the second armature 18 through the threaded aperture 73. While, in the preferred embodiment, each of the first fastener 26 and the second fastener 27 comprise a head 46 and 47 and a threaded end 48 and 49, it should be clearly understood that substantial benefit could be derived from an alternative configuration of the of the present invention in which the first fastener 26 and the second fastener 27 do not have a head 46 and 47 and a threaded end 48 and 49, so long as the first fastener 26 and the second fastener 27 are capable of securely fastening the surface interface 31 to the first armature 15 and the second armature 18. Furthermore, it is within the spirit and scope of this invention that the retractable skate 10 lack a first fastener 26 and a second fastener 27, so long as the surface interface can be securely coupled to the first armature 15 and the second armature 18. For example, a spring-biased locking mechanism may be built into the first armature 15 and the second armature 18 or into the surface interface 31 or both in order to facilitate the secure coupling of the surface interface 31 to the first armature 15 and the second armature 18.

In the preferred embodiment, the second end 17 of the first armature 15 of retractable skate 10 is forked (FIGS. 4 and 5). The forked second end 17 of the first armature 15 has a first tine 33 and a second tine 35 dimensioned to accommodate the at least one surface interface 31 between the first tine 33 and the second tine 35 of the first armature 15. Preferably, each of the first tine 33 and the second tine 35 of the first armature 15 defines an aperture 70 positioned and dimensioned for accommodating the first fastener 26.

In the preferred embodiment, the second end 20 of the second armature 18 of retractable skate 10 is also forked. The forked second end 20 of the second armature 18 has a first tine 37 and a second tine 39 dimensioned to accommodate the at least one surface interface 31 between the first tine 37 and the second tine 39 of the second armature 16B. Each of the first tine 37 and the second tine 39 of the second armature 18 defines an aperture 71 positioned and dimensioned for accommodating the second fastener 27. While, in the preferred embodiment, each of armatures 15 and 18 are forked having a first tine 33 and 37 and a second tine 35 and 39, it should be clearly understood that substantial benefit could be derived from an alternative configuration of the of the present invention in which at least one of armatures 15 and 18 are forked having more than two tines so long as the surface interface 31 can be securely coupled to armatures 15 and 18. Furthermore, it is within the spirit and scope of this invention that the retractable skate 10 have at least one of armatures 15 and 18 not being forked, so long as the surface interface can be securely coupled to armatures 15 and 18. For example, the retractable skate 10 may have the first armature 15 being forked to provide increased strength in coupling to the surface interface and have the second armature 18 not being forked for decreased weight and lower cost of manufacture. In addition, while in the preferred embodiment, each of tines 33 and 35 define and aperture 70 and tines 37 and 39 define an aperture 71 for accommodating a fastener, it should be clearly understood that substantial benefit could be derived from an alternative configuration of the of the present invention in which each of tines 33, 35, 37 and 39 define more than one aperture, for example, to provide a selection of positions for inserting the fastener to couple the surface interface to the retractable skate. Furthermore, it is within the spirit and scope of this invention that the retractable skate 10 not define apertures in the tines 33 and 35 or armature 15 and tines 37 and 39 or armature 18 so long as the fasteners 26 and 27 are capable of securely coupling the surface interface between the tines 33 and 35 of armature 15 and between the tines 37 and 39 of armature 18. For example, the retractable skate 10 may instead comprise compressible fasteners defining a cavity in each end, and the tines of each armature having protrusions being dimensioned to securely couple to the cavities of the compressible fasteners.

In the preferred embodiment, the aperture 72 defined by the first tine 33 of the first armature 15 is threaded and dimensioned to couple with the threaded end 48 of the first fastener 26. Likewise, the aperture 73 in the first tine 37 of the second armature 18 is threaded and dimensioned to couple with the threaded end 49 of the second fastener 27. The threaded apertures 72 of the first armature 15 and the threaded aperture 73 of the second armature 18 are preferably both on the skater's left side, enabling a skater to couple the at least one surface interface 31 to the armatures 15 and 18 by attaching fasteners 26 and 27 with each threaded end 48 and 49 of each fastener 26 and 27 to the skater's left and each head 46 and 47 of each fastener 26 and 27 on the skater's right. This preferred orientation positions the heads 46 and 47 of fasteners 26 and 27 away from a skating surface as a skater leans into a left-hand turn typical of traditional speed skating courses. While, in the preferred embodiment, a first tine 33 of the first armature 15 defines a threaded aperture 72 and the first tine 37 of the second armature 18 defines a threaded aperture 73, dimensioned to couple to the threaded end 48 of fastener 26 and the threaded end 49 of fastener 27, respectively, on a skater's left side so that the head 46 and 47 of each fastener 26 and 27 is on a skater's right side, it should be clearly understood that substantial benefit could be derived from an alternative configuration of the of the present invention in which the at least one of heads 46 and 47 is on a skater's left side, so long as heads 46 and 47 do not contact a skating surface during a turn. Furthermore, it is within the spirit and scope of this invention that the retractable skate 10 have at least one armature that does not define a threaded aperture so long as the fastener may be securely coupled the armature to the surface interface. For example, the retractable skate 10 may further comprise a nut having threads dimensioned to engage the threaded end of at least one of the fasteners 26 and 27 so that the fastener 26 or 27 can be securely coupled to the forked armature by extending the fastener 26 or 27 through the aperture of each tine and engaging the threaded end with the nut.

Figure 6:
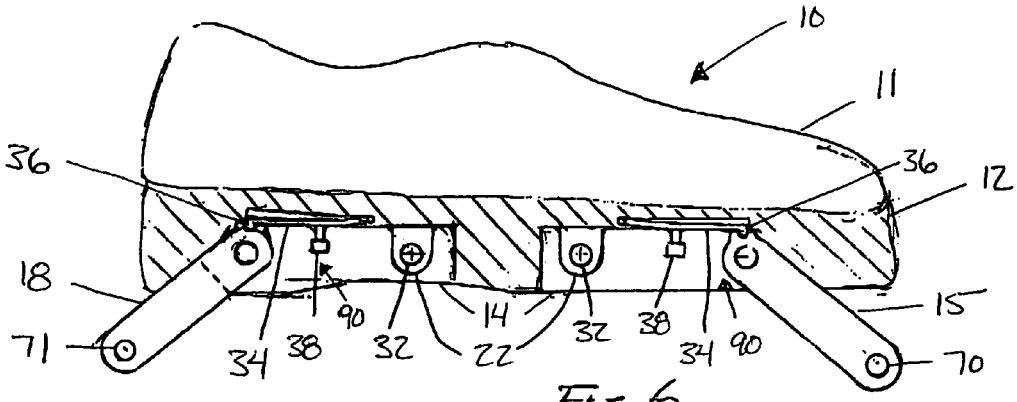
FIG. 6 is an illustration depicting a side elevational and partially perspective and partially cross-sectional view of a retractable inline speed skate showing a mechanism for locking armatures in a skating position in accordance with a preferred embodiment of the present invention.
Figure 7:
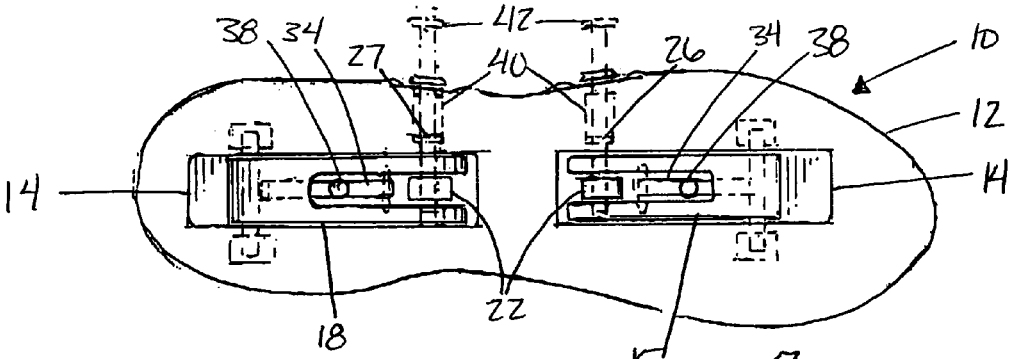
FIG. 7 is an illustration depicting a bottom view of the retractable inline speed skate of FIG. 6 showing a mechanism for locking armatures in a walking position in accordance with a preferred embodiment of the present invention.

Referring now to FIGS. 6 and 7, the retractable skate 10 preferably further comprises at least one protrusion 22, and preferably two protrusions 22, coupled to the sole 12 proximate the recess 14. The protrusion 22 defines at least one aperture 32 dimensioned to be in alignment with at least one of the apertures 70 and 71 defined in the first tines 33 and 37 and second tine 35 and 39 of the armatures 15 and 18 when at least one of the armatures 15 and 18 is in a stored position within the recess 14. The aperture 32 is dimensioned to receive at least one of the fasteners 26 and 27 or at least one of the armatures 15 and 18 for securely retaining at least one of the armatures 15 and 18 in a stored position within the recess 14.

While, in the preferred embodiment, a protrusion 22 proximate the recess 14 defines an aperture 32 dimensioned and positioned to secure an armature in a stored position, it should be clearly understood that substantial benefit could be derived from an alternative configuration of the of the present invention in which the protrusion 22 does not define an aperture so long as the protrusion 22 is capable of securely coupling to the armature in a stored position, such as a spring-biased protrusion dimensioned as a hook for retaining an armature in the recess. Furthermore, it is within the spirit and scope of this invention that the retractable skate 10 have other means of securing an armature within the recess 14. For example, the retractable skate 10 may have a retaining piece (not shown) dimensioned to be positioned over an armature stored in the recess and secured by, for example, a threaded shaft that engages a threaded cavity defined by the recess.

In the preferred embodiment, both of the first fastener 26 and the second fastener 27 are removable, and the sole 12 defines at least one channel 40, and preferably two channels 40, extending from a side of the sole 12 to the recess 14 as shown in FIG. 7. The channel 40 is dimensioned to receive at least one of the first fastener 26 and the second fastener 27. Preferably, the channels 40 are positioned and aligned for insertion of each fastener 26 and 27 into the recess 14 for securing at least one of the armatures 15 and 18 in a stored position. Caps 42 may fasten to a side of sole 12 and be dimensioned to cover the channel 40 for enhancing the appearance of the present invention and preventing foreign materials such as dirt or mud from entering the channel 40.

Figure 10:
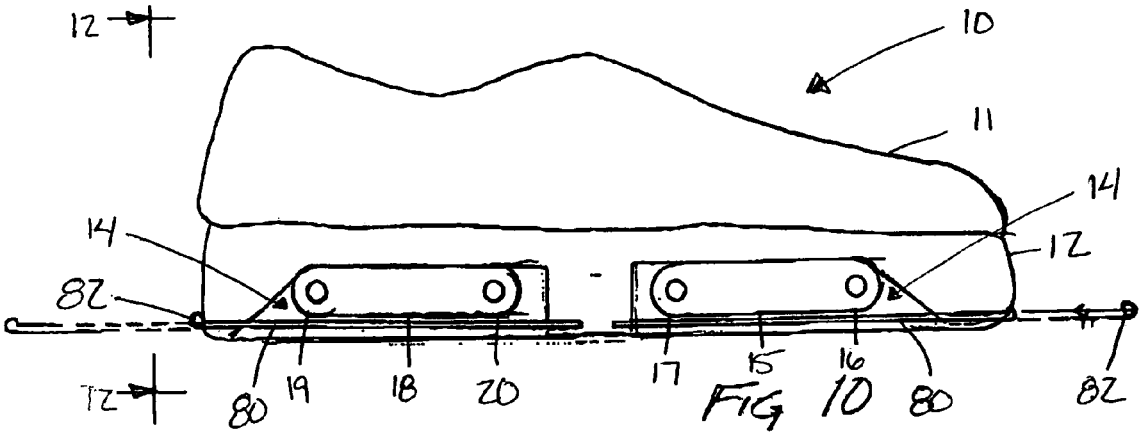
FIG. 10 is an illustration depicting a side elevational view with parts broken away to show a retractable inline speed skate in a walking position having sliding panels in accordance with a preferred embodiment of the present invention.
Figure 17:
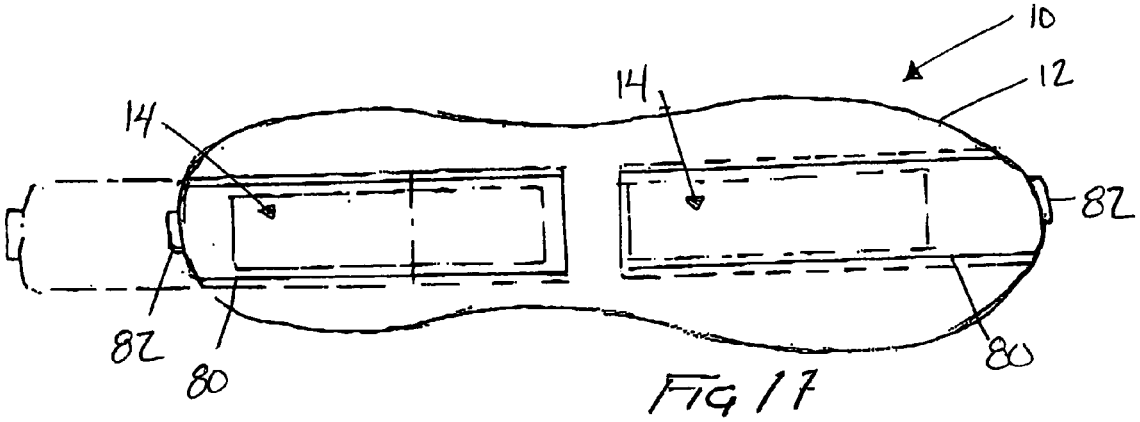
Figure 12:
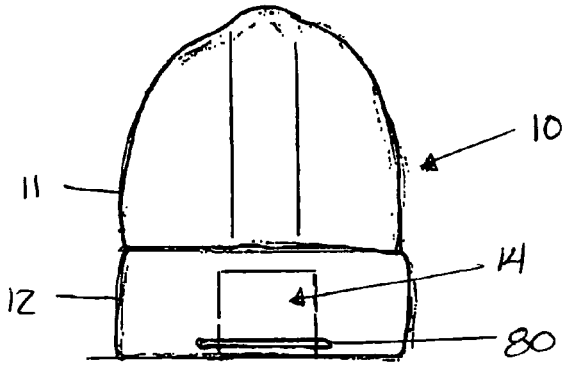
FIG. 12 is an illustration depicting a side elevational view of the heel of the retractable inline speed skate of FIG. 10 in a walking position with a portion broken away to show a sliding panel in accordance with a preferred embodiment of the present invention.

Another method of securing the armatures 15 and 18 in a walking position in accordance with another embodiment of the present invention is depicted in FIGS. 10, 11, and 12. In this embodiment at least one cover 80, and preferably two covers 80, is coupled to the sole 12 and dimensioned to cover the recesses 14. Preferably, the covers 80 are slidably coupled to the sole 12 for holding the armatures 15 and 18 within the recesses 14 and may also prevent foreign materials such as water, mud, or dirt from entering the recesses 14. The armatures 15 and 18 may preferably be positioned to an extended position by positioning the covers 80 to uncover the recesses 14 and allow rotation of the armatures 15 and 18 to an extended position. Preferably, each cover 80 has an extended element 82 for allowing a wearer to easily manipulate the cover 80 by hand. To enhance appearance and improve traction during non-skating use, the covers 80 are preferably colored and textured to match the sole 12.

Although the present embodiment of the present invention depicts the covers 80 slidably coupled to sole 12, it should be clearly understood that significant benefit may be derived from an alternate embodiment of the present invention having the covers 80 hinged to the sole 12 or removably secured over the recess 14 by clips or by frictional contact with sides of the recess 14. Furthermore, it is within the spirit and scope of this invention that the retractable skate 10 have a single cover 70 dimensioned to secure both armatures 15 and 18 in a stored position within a single or multiple recesses 14, or at least one cover 80 that secures the armatures 15 and 18 within the recesses 14 without completely covering the recesses 14.

Armatures 15 and 18 may be held in an extended position by a frictional resistance of the pivotal coupling between the first end of each of armatures 15 and 18 along with the body weight of a skater and also additional forces exerted on the armatures 15 and 18 during skating. However, because a skater may use the present invention on a non-competition surface where a skater may encounter obstructions such as cracks, rocks, and bumps, a locking mechanism may be preferred to secure the armatures 15 and 18 in an extended position.

One preferred locking mechanism 90 in accordance with an alternative embodiment of the present invention is depicted in FIG. 6. FIG. 6 shows a cross-sectional view of an embodiment of the retractable skate 10 comprising at least one spring 34, and preferably two springs 34, coupled to the sole 12 proximate the at least one recess 14. The retractable skate 10 further comprises at least one locking protrusion 36 coupled to the at least one spring 34. The first armature 15 defines at least one cavity 28 (see FIG. 5) dimensioned to retain the at least one protrusion 36 to prevent motion of the first armature 15. The second armature 18 also defines at least one cavity 28 dimensioned to retain the at least one protrusion 36 to prevent motion of the second armature 18.

As shown in FIG. 6, each spring 34 has one end fastened within recess 14 and a locking protrusion 36 on the other end. The protrusion 36 is dimensioned to securely engage the cavity 28 defined by the armature 15 or 16 (see FIG. 5) when the armature 15 or 18 is in a desired position. Although the armature 15 or 18 may define a single cavity 28 dimensioned to engage the protrusion 36, it will be understood that significant benefit may be derived from an armature 15 or 18 defining more than one cavity 28 dimensioned to engage the protrusion 36 for providing more than one position at which the armature 15 or 18 may be locked; for example, a speed skating position, a trick-skating position, or a downhill skating position. It will also be understood that significant benefit may also be derived by at least one of armatures 15 and 18 defining more than one cavity 28 and the protrusion 36 having a substantially angled portion dimensioned to allow a ratcheting behavior as the protrusion 36 sequentially engages the cavities 28 when the armature 15 or 18 is rotated to a preferred extended position.

Furthermore, it is within the spirit and the scope of the present invention that one or both armatures 15 and 18 not define a cavity 12 with the spring 34 and locking protrusion 36. For example, for decreased weight and cost of manufacturing, only the first armature 15 of each foot may define a cavity 12 with the spring 34 and locking protrusion 36. As another example, if one leg typically supports the majority of a skater's weight, then the skater may prefer to only have one or both armatures 15 and 18 of the low-weight bearing leg define a cavity 12 with the spring 34 and locking protrusion 36.

Preferably, spring 34 further comprises a release mechanism such as a stud 38 coupled to the spring 34 so that the protrusion 36 disengages from the cavity 28 when the stud 38 is pressed, allowing the armature 15 or 18 to move. Although FIGS. 5 and 6 show the armatures 15 and 18 defining cavities 28 and the spring 34 having an engaging protrusion 36 to accomplish a locking behavior, it will be clearly understood that substantial benefit could be derived from an alternate embodiment such as having a single spring 34 having at least one protrusion 36 that simultaneously engages both armatures 15 or 18.

It should also be clearly understood that at least one cavity 28 may be positioned so that the protrusion 36 engages the cavity 28 when the armature 15 or 18 has been rotated into a stored position to secure the armature 15 or 18 within the recess 14. Furthermore, the securing of the armatures 15 and 18 in a desired position generally, and specifically in a stored position within the at least one recess 14, may be accomplished in an alternate embodiment of the present invention comprising at least one protrusion 36 coupled to the sole 12 proximate the at least one recess 14. The at least one protrusion 36 is dimensioned to securely mate with the at least one cavity 28 defined by each of the first armature 15 and the second armature 18. One method of coupling the at least one protrusion 36 to the sole 12 is depicted in FIG. 6 using a spring 34. However, it is within the spirit and scope of the present invention to use any method of coupling the at least one protrusion 36 to the sole 12 so long as the coupling allows the protrusion 36 to securely mate to the cavity 28 for securing the armatures 15 and 18. For example, the protrusion 36 may be coupled to the sole 12 via a pivoting or telescoping element for engaging and disengaging the protrusion 36 with the cavity 28.

In accordance with one embodiment of the invention, a method is disclosed of using the retractable skate 10 comprising the steps of providing a sole 12 dimensioned to be coupled to a shoe 11 and defining at least one recess 14 therein. The method further comprises the steps of providing a first armature 15, a second armature 18, and at least one surface interface for effective travel on a surface. The first armature 15 has a first end 16 and a second end 17 and dimensioned to be retained in a stored position in the at least one recess 14 of the sole 12, the first end 16 of the first armature 15 being pivotally coupled to the sole 12 within the at least one recess 14. The second armature 18 has a first end 19 and a second end 20 and dimensioned to be retained in a stored position in the at least one recess 14 of the sole 12, the first end 18 of the second armature 18 being pivotally coupled to the sole 12 within the at least one recess 14.

After providing the sole 12, first and second armatures 15 and 18, and surface interface 31, the method of using the retractable skate 10 further comprises the step of extending both the second end 17 of the first armature 15 and the second end 20 of the second armature 18 out of the at least one recess 14, followed by coupling the at least one surface interface 31 to both of the second end 17 of the first armature 15 and the second end 20 of the second armature 18. Finally, the method of using the retractable skate 10 comprises the step of traveling with the at least one surface interface 31 making contact with a travel surface.

Although the method of use of the present embodiment comprises the step of traveling with the surface interface 31 making contact with a travel surface, it should be clearly understood that the step of traveling also includes all movement along a skating surface using of a pair of retractable skates 10, each retractable skate 10 of the pair alternately contacting the skating surface or being removed from the skating surface as the other retractable skate 10 contacts the skating surface. Furthermore, it is within the spirit and scope of this invention that traveling includes all movement relative to a travel surface: for example, the movements of a figure skater including spins, leaps, and other movements where the surface interface does not contact the travel surface for a period of time. As another example, rollerblading techniques such as sliding atop a railing or aerial maneuvers such as performed during a rollerblade competition are also within the spirit and scope of the present invention.

Preferably, the surface interface 31 is one of a blade 60, a frame 50 housing a plurality of wheels 52, and a pair of wheels 24 and 25. The blade 60 is adapted to provide low-friction directional travel on an icy surface, while the wheels 24, 25 and 52 provide low-friction directional travel on other relatively smooth surfaces.

In accordance with another embodiment of the invention, a method of using the retractable skate 10 of the present invention preferably further comprises the step of detaching the at least one surface interface 31 from the first armature 15 and the second armature 18. The method next comprises the steps of securing the first armature 15 in the at least one recess 14, and securing the second armature 18 in the at least one recess 14. Performing the steps of detaching the surface interface 31 and storing both armatures 15 and 18 within the recess 14 allows a quick conversion to normal movement such as walking or running with the retractable skate 10 without having to remove the shoe 11 or the sole 12.

In accordance with another embodiment of the invention, a method of using the retractable skate 10 preferably further comprises the step of providing a first fastener 26 and a second fastener 27. Preferably, the surface interface 31 comprises a first wheel 24 defining an axial aperture 44 and a second wheel 25 defining an axial aperture 45.

To fasten the first wheel 24 and the second wheel 25, the method of using the retractable skate 10 preferably further comprises the step of inserting the first fastener 26 through both the axial aperture 44 of the first wheel 24 and an aperture 70 defined by the second end 17 of the first armature 15 to couple the first wheel 24 to the second end 17 of the first armature 15. Similarly, the method of use further comprises the step of inserting the second fastener 27 through both the axial aperture 45 of the second wheel 25 and an aperture 71 defined by the second end 20 of the second armature 18 to couple the second wheel 25 to the second end 20 of the second armature 18.

The method of using the retractable skate according to the present embodiment preferable further comprises the steps of removing the first fastener 26 from both the axial aperture 44 of the first wheel 24 and the second end 17 of the first armature 15, and removing the second fastener 27 from both the axial aperture 45 of the second wheel 25 and the second end 20 of the second armature 18.

In accordance with another embodiment of the invention, the method of using the retractable skate 10 further comprises the step of providing at least one cover 80 coupled to the sole 12 and dimensioned to cover the at least one recess 14. Extending the armatures 15 and 18 from within the recess is accomplished by the step of moving the at least one cover 80 to uncover the at least one recess 14 to extend at least one of the first armature 15 and the second armature 18 out of the at least one recess 14. Storing the armatures 15 and 18 is accomplished by the step of moving the at least one cover 80 to cover the at least one recess 14 after the first armature 15 and the second armature 18 are stored in the at least one recess 14.

In accordance with another embodiment of the invention, a method of using the retractable skate 10 further comprises the steps of securing the first armature 15 in the at least one recess 14 and securing the second armature 18 in the at least one recess 14.

In accordance with another embodiment of the invention, a method of using the retractable skate 10 further comprises the step of providing at least one locking mechanism 90 coupled to the sole 12 proximate the at least one recess 14 and dimensioned to lock at least one of the first armature 15 and the second armature 18 in an extended position out of the at least one recess 14. In addition, using the retractable skate 10 includes the step of locking at least one of the first armature 15 and the second armature 18 in an extended position out of the at least one recess 14. Also, the method of using the retractable skate 10 includes the step of disengaging the at least one locking mechanism 90 from at least one of the first armature 15 and the second armature 18 before storing at least one of the first armature 15 and the second armature 18.

While the invention has been particularly shown and described with reference to the preferred embodiments thereof, it will be understood by those skilled in the art that the foregoing and other changes in form, and details may be made therein without departing from the spirit and scope of the invention. For example, in the preferred embodiment, the surface interface comprises one of a blade, a pair of wheels, and a frame housing a plurality of wheels, it should be clearly understood that substantial benefit could be derived from an alternative embodiment of the present invention in which an alternative surface interface is used, such as skis, so long as that surface interface is capable of permitting a person to travel effectively on a surface. As a second example, each armature may have a pivoting mechanism allowing an attached wheel to pivot sideways and store within the recess defined by the sole without first decoupling the wheel from the armature. As a third example, the armatures may be textured and dimensioned to provide adequate friction for walking when in a stored position.

What is claimed is:

1. A retractable skate comprising, in combination:

a sole dimensioned to be coupled to a shoe, said sole defining at least one recess therein;

a first armature having a first end and a second end and dimensioned to be retained in a stored position in said at least one recess of said sole, said first end of said first armature being pivotally coupled to said sole within said at least one recess, said second end of said first armature being dimensioned to extend out of said at least one recess when in use;

a second armature having a first end and a second end and dimensioned to be retained in said at least one recess of said sole, said first end of said second armature being pivotally coupled to said sole within said at least one recess, said second end of said second armature being dimensioned to extend out of said at least one recess when in use;

at least one surface interface for providing travel on a surface and dimensioned to be coupled to said second end of said first armature and said second end of said second said second end of said second armature being extended out of said at least one recess;

a first fastener dimensioned to couple said at least one surface interface to said second end of said first armature;

a second fastener dimensioned to couple said at least one surface interface to said second end of said second armature;

said second end of said first armature being forked and having a first tine and a second tine for accommodating said at least one surface interface therebetween said first tine and said second tine of said first armature each defining an aperture for accommodating said first fastener therethrough, said second end of said second armature being forked and having a first tine and a second tine for accommodating said at least one surface interface therebetween, said first tine and said second tine of said second armature each defining an aperture for accommodating said second fastener therethrough; and at least one protrusion coupled to said sole proximate said at least one recess, said at least one protrusion defining at least one aperture dimensioned to be in alignment with at least one of said apertures of said first tine and said second tine of said first armature and said apertures of said first tine and said second tine of said second armature when at least one of said first armature and said second armature being retained in said at least one recess of said sole, said at least one protrusion dimensioned to retain at least one of said first fastener and said second fastener and said first armature and said second armature through said at least one aperture of said at least one protrusion.

2. The retractable skate of claim 1 wherein said first fastener and said second fastener each comprise a head and a threaded end, each said head having ridges dimensioned to allow each of said first fastener and said second fastener to be rotated by hand, said threaded end of said first fastener dimensioned to be coupled to said second end of said first armature through a threaded aperture defined by said second end of said first armature, said threaded end of said second fastener dimensioned to be coupled to said second end of said second armature through a threaded aperture defined by said second end of said second armature.

3. The retractable skate of claim 1 wherein said first fastener and said second fastener each comprise a head and a threaded end, said aperture in said first tine of said first armature being threaded for fastening said threaded end of said first fastener, said aperture in said first tine of said second armature being threaded for fastening said threaded end of said second fastener, so that said head of said first fastener and said head of said second fastener being positioned away from a skating surface when a skater leans into a left-hand turn.

4. The retractable skate of claim 1 wherein said first fastener being removable, said second fastener being removable, said sole defining at least one channel extending from a side of said sole to said at least one recess, said at least one channel dimensioned to receive at least one of said first fastener and said second fastener.

5. The retractable skate of claim 1, further comprising means for securing said first armature and said second armature within said at least one recess.

6. The retractable skate of claim 5 wherein said means for securing comprises at least one cover coupled to said sole and dimensioned to cover said at least one recess.

7. The retractable skate of claim 5 wherein said means for securing comprises at least one protrusion coupled to said sole proximate said at least one recess and dimensioned to securely mate with at least one cavity defined by each said first armature and said second armature.

8. The retractable skate of claim 1 wherein said surface interface being one of a blade, a pair of wheels, and a frame housing a plurality of wheels.

9. The retractable skate of claim 1, further comprising:

at least one spring coupled to said sole proximate said at least one recess; and at least one locking protrusion coupled to said at least one spring;

said first armature defining at least one cavity dimensioned to retain said at least one locking protrusion to prevent motion of said first armature, said second armature defining at least one cavity dimensioned to retain said at least one looking protrusion to prevent motion of said second armature.

10. A retractable skate comprising, in combination:

a sole dimensioned to be coupled to a shoe, said sole defining at least one recess therein;

a first armature having a first end and a second end and dimensioned to be retained in a stored position in said at least one recess of said sole, said first end of said first armature being pivotally coupled to said sole within said at least one recess, said second end of said first armature being dimensioned to extend out of said at least one recess when in use;

a second armature having a first end and a second end and dimensioned to be retained in said at least one recess of said sole, said first end of said second armature being pivotally coupled to said sole within said at least one recess, said second end of said second armature being dimensioned to extend out of said at least one recess when in use;

at least one surface interface for providing travel on a surface and dimensioned to be coupled to said second end of said first armature and said second end of said second armature when said second end of said first armature and said second end of said second armature being extended out of said at least one recess;

a first fastener dimensioned to couple said at least one surface interface to said second end of said first armature;

a second fastener dimensioned to couple said at least one surface interface to said second end of said second armature;

said second end of said first armature being forked and having a first tine and a second tine for accommodating said at least one surface interface therebetween, said first tine and said second tine of said first armature each defining an aperture for accommodating said first fastener therethrough, said second end of said second armature being forked and having a first tine and a second tine for accommodating said at least one surface interface therebetween, said first tine and said second tine of said second armature each defining an aperture for accommodating said second fastener therethrough; and at least one protrusion coupled to said sole proximate said at least one recess, said at least one protrusion being configured to be coupled to said first tine and said second tine of said first armature and to said first tine and said second tine of said second armature when at least one of said first armature and said second armature being retained in said at least one recess of said sole, said at least one protrusion also being configured to retain at least one said first fastener and said second fastener and said first armature and said second armature.

* * * * *